US005190837A

United States Patent [19]

Sakai et al.

[11] Patent Number: 5,190,837

[45] Date of Patent: Mar. 2, 1993

[54] IMAGE HOLDER MEMBER HAVING RESIN LAYER OF METAL-COATED FINE RESIN PARTICLES AND BINDER RESIN

[75] Inventors: Kiyoshi Sakai, Chofu; Hisami Tanaka; Naoto Fujimura, both of Yokohama; Teigo Sakakibara, Tokyo; Takashi Koyama, Yokohama, all of Japan

[73] Assignee: Canon Kabushiki Kaisha, Tokyo, Japan

[21] Appl. No.: 598,966

[22] Filed: Oct. 17, 1990

[30] Foreign Application Priority Data

Oct. 17, 1989 [JP] Japan ..... 1-271061

[51] Int. Cl.[5] ..... G03G 5/14

[52] U.S. Cl. ..... 430/58; 430/63; 430/65; 428/208

[58] Field of Search ..... 430/58, 63, 65; 428/208

[56] References Cited

U.S. PATENT DOCUMENTS

| | | | |
|---|---|---|---|
| 3,493,369 | 2/1970 | Busch et al. | 430/63 |
| 3,748,137 | 7/1973 | Worth et al. | 430/63 |
| 4,230,785 | 10/1980 | Carlson et al. | 430/63 |
| 4,377,629 | 3/1983 | Tarumi et al. | 430/62 |
| 4,416,963 | 11/1983 | Takimoto et al. | 430/63 |
| 4,518,669 | 5/1985 | Yashiki | 430/57 |
| 4,618,552 | 6/1986 | Tanaka et al. | 430/60 |
| 4,657,835 | 4/1987 | Yashiki | 430/60 |
| 4,775,605 | 10/1988 | Seki et al. | 430/63 |

FOREIGN PATENT DOCUMENTS

| | | |
|---|---|---|
| 59-84257 | 5/1984 | Japan . |
| 58-181054 | 5/1985 | Japan . |
| 2072535 | 10/1981 | United Kingdom . |
| 2156089 | 10/1985 | United Kingdom . |

*Primary Examiner*—Marion E. McCamish
*Assistant Examiner*—C. D. RoDee
*Attorney, Agent, or Firm*—Fitzpatrick, Cella, Harper & Scinto

[57] ABSTRACT

An image holding member comprises an electroconductive substrate, a resin layer, and an image holding layer. The resin layer is placed between the electroconductive substrate and the image holding layer. The resin layer comprises metal-coated fine resin particles, and a binder resin.

15 Claims, 2 Drawing Sheets

IMAGE HOLDER MEMBER HAVING RESIN LAYER OF METAL-COATED FINE RESIN PARTICLES AND BINDER RESIN

BACKGROUND OF THE INVENTION

Field of the Invention

The present invention relates to an image holding member, particularly to an image holding member having superior potential characteristics.

Image holding members are generally used as electrophotographic photosensitive members, electrostatic image-and/or toner-image-holding members such as intermediate transfer members or electrostatic recording members, in which many times of image transfer is required, printing plates, and the like.

In the aforementioned electrophotographic photosensitive members which are basically constituted of an electroconductive substrate and a photosensitive layer, a subbing layer provided between the electroconductive substrate and the photosensitive layer is known to be effective in improvement of adhesiveness of the photosensitive layer to the substrate, improvement of coating characteristics of the photosensitive layer, protection of the electroconductive substrate, coating of the defects of the electroconductive substrate, protection of the photosensitive layer against electrical damage, improvement of charge-injection from the electroconductive substrate to the photosensitive layer, and other purposes.

Known materials for the subbing layer include polyvinyl alcohol, polyvinyl methyl ether, poly-N-vinylimidazole, ethylcellulose, methylcellulose, ethylene-acrylate copolymers, casein, gelatin, polyamides, and the like.

As a characteristic required for the subbing layer is mainly named an electric property. As used in an electrophotographic photosensitive member, the subbing layer should not adversely affect the electrophotographic characteristics of the photosensitive member. Accordingly, the electric resistance thereof is required to be low. In positive development, a high electric resistance of the subbing layer causes the voltage on electrification to be applied to the subbing layer, resulting in a high residual potential to cause fogging of the image, while in reversal development, it lowers the image density. Additionally, the electric resistance is required not to be adversely affected by variation of external environment, especially by variation of atmospheric humidity: a low humidity, for example, raises the electric resistance.

In order to achieve the high contrast of the image, the surface potential is required to be as high as possible and the light portion potential to be as low as possible.

In image holding members other than the electrophotographic photosensitive member, for example, in an electrostatic recording member having an electroconductive substrate and a dielectric layer, an intermediate layer provided between a substrate and a dielectric layer is also required to have similar characteristics.

Accordingly, an extremely thin resin layer, and a dispersion of a metal or a metal oxide as a particulate electroconductive material are proposed for this purpose (Japanese Patent Application Laid-open No. 59-84257, and No. 58-181054). The present invention provides a subbing layer having still better characteristics.

SUMMARY OF THE INVENTION

An object of the present invention is to provide an image holding member which is capable of giving excellent images.

Another object of the present invention is to provide an image holding member which has a resin layer of low electrical resistance, and electrical characteristics such as potential-retaining ability and potential contrast independent of variation of environment.

According to an aspect of the present invention, there is provided an image holding member comprising an electroconductive substrate, a resin layer, and an image holding layer; the resin layer being placed between the electroconductive substrate and the image holding layer, and the resin layer comprising metal-coated fine resin particles and a binder resin.

According to another aspect of the present invention, there is provided an electrophotographic apparatus, comprising an image holding member, an electrostatic latent image-forming means, a developing means for developing the formed electrostatic latent image, and a transfer means for transferring a developed image to a transferred image-receiving material: the image holding member comprising an electroconductive substrate, a resin layer, and a photosensitive image-holding layer, the resin layer being placed between the electroconductive substrate and the photosensitive image-holding layer, and the resin layer comprising metal-coated fine resin particles and a binder resin.

According to still another aspect of the present invention, there is provided a device unit comprising an image holding member, an electrifying means, and a cleaning means: the image holding member comprising an electroconductive substrate, a resin layer, and a photosensitive image-holding layer, the resin layer being placed between the electroconductive substrate and the photosensitive image-holding layer, said resin layer comprising metal-coated fine resin particles and a binder resin, the device unit being supported integrally with the image holding member, the electrifying means and the cleaning means, and the device unit is mountable to and demountable from a main apparatus.

According to a further aspect of the present invention, there is provided a facsimile machine comprising an electrophotographic apparatus having an image holding member, and an information receiving means for receiving image information from a remote terminal: the image holding member comprising an electroconductive substrate, a resin layer, and a photosensitive image-holding layer, the resin layer being placed between the electroconductive substrate and the photosensitive image-holding layer, and the resin layer comprising metal-coated fine resin particles and a binder resin.

DETAILED DESCRIPTION OF THE PREFERRED EMBODIMENT

Figure 1:
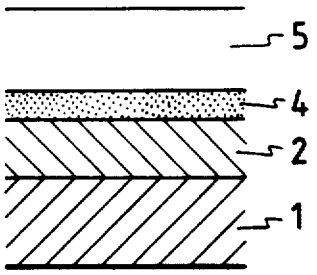
FIGS. 1 to 3 illustrate examples of constitution of an electrophotographic photosensitive member of the present invention.

In the electrophotographic photosensitive member of the present invention, a resin layer, in which fine resin particles coated externally with a metal are dispersed in a binder resin, is employed as a subbing layer between an electroconductive substrate and a photosensitive layer. Thereby, the surface potential is kept high, the dark decay is considerably reduced in comparison with conventional method in which metal particles are merely dispersed in a binder, and the resulting image has no defect like fogging and defective dots.

The metal for the coating in the present invention has preferably a work function of not more than 4.6. The reason is that such a metal has sufficient electroconductivity and yet keeps inherent high sensitivity of the photosensitive layer owing to ability of inhibiting electric charge injection.

The fine particles to be coated with a metal in the present invention are preferably made of a thermoplastic resin or a thermosetting resin.

The thermoplastic resin includes acrylic resins, styrene resins, polycarbonate resins, polyester resins, polyamide resins, and the like.

The acrylic resins include polymers of methyl methacrylate, ethyl methacrylate, isopropyl methacrylate, phenyl methacrylate, methyl acrylate, ethyl acrylate, etc., copolymers of these monomers, copolymers of any of these monomers and another monofunctional monomer, and the like.

The styrene resins include polymers of styrene, methylstyrene, chlorostyrene, etc., copolymers of these monomers, copolymers of any of these monomers and another monofunctional monomer, and the like.

The polycarbonate resins includes a polycondensate of bisphenol A and phosgene, and a polycondensate of bisphenol Z and phosgene, etc.

The polyester resins includes polycondensates or copolycondensate of a dicarboxylic acid such as terephthalic acid, isophthalic acid, orthophthalic acid, etc. with ethylene glycol, propylene glycol, or glycerin.

The polyamide resins include polycondensate of $\epsilon$-aminocaproic acid, $\omega$-aminoundecanoic acid, etc. and polycondensates of hexamethylenediamine and adipic acid, and the like.

The thermosetting resins includes silicone resins, melamine resins, urea resins, phenol resins, epoxy resins, acrylic resins, styrene resins, and the like.

The silicone resins include heat-curable silicone rubbers, room-temperature-curing silicone rubbers, silicone resins, and modified silicone resins.

The melamine resins includes condensates of melamine and cyanuric acid, polycondensates of melamine and formaldehyde, and the like.

The urea resins includes polycondensates of methylol urea, and the like.

The phenol resins include resol type phenol resins, and the like.

The epoxy resins include polycondensates of a bisphenol and epichlorohydrin, and the like.

The acrylic resins include copolymers of a monofunctional monomer such as methyl methacrylate, ethyl methacrylate, isopropyl methacrylate, phenyl methacrylate, methyl acrylate, ethyl acrylate, etc. with a polyfunctional monomer such as divinylbenzene, and trivinylbenzene, etc., and the like.

The styrene resins include copolymers of a monofunctional monomer such as styrene, methylstyrene, chlorostyrene, etc. with a polyfunctional monomer such as divinylbenzene, trivinylbenzene, etc., and the like.

The resins for the fine resin particles are mentioned above as examples without limiting the present invention.

The shape of the fine resin particles is preferably spherical, in particular, completely spherical, or ellipsoidal.

The volume-average particle diameter of the fine resin particles is preferably within the range of from 0.1 $\mu$m to 4 $\mu$m, more preferably from 0.5 $\mu$m to 3 $\mu$m. A smaller volume-average particle diameter causes higher resistance of the layer and poorer dispersibility of the particles, while a larger diameter thereof causes poorer coating suitability of the layer.

The metals for coating the fine resin particles in the present invention include Al, Ag, Zn, Cr, Si, Rh, Au, Ni, etc. in view of electroconductivity, ease of coating, and other characteristics. Particularly preferable are Al, Ag, Zn, Cr, etc. which have a work function of not higher than 4.6.

The resin particles in the present invention may be coated with a metal according to vacuum vapor deposition, non-electrolytic plating, ball milling, and the like method.

The binder resins employed in the present invention for dispersing and retaining the fine resin particles include polyarylate resins, polysulfone resins, polyamide resins, acrylic resins, acrylonitrile resins, methacrylic resins, vinyl chloride resins, vinyl acetate resins, phenol resins, epoxy resins, polyester resins, alkyd resins, polycarbonate resins, and polyurethane resins; and copolymer type of the above resins such as styrene-butadiene copolymers, styrene-acrylonitrile copolymers, styrene-maleic acid copolymers, and the like.

Particularly preferable resins in the present invention are thermosetting resins such as acrylic resins, methacrylic resins, phenol resins, styrene resins, polyurethane resins, epoxy resins, alkyd resins, polyester resins, silicone resins, melamine resins and copolymer type resins thereof, curable rubbers, and the like.

The electrophotographic photosensitive member of the present invention is basically constituted sequentially of an electroconductive substrate 1, a resin layer 2 containing metal-coated fine resin particles, and a photosensitive layer. The photosensitive layer contains a charge-generating substance and a charge-transporting substance within one layer. The photosensitive layer may be either of a monolayer type or of a laminated type (FIG. 1) having a charge-generating layer 4 (CGL) and a charge-transporting layer 5 (CTL). The lamination type of layer may be provided in the order of an electroconductive substrate, a CGL, and a CTL, or in the order of an electroconductive substrate, a CTL, and a CGL.

The charge-generating substances mainly used in the photosensitive layer are organic photoconductive substances, particularly pigments. However, solvent-soluble dyes made in a particle form by use of a selected solvent may be used therefor. Inorganic materials may also be used.

The pigments include phthalocyanine pigments, anthanthrone pigments, dibenzopyrene pigments, pyranthrone pigments, azo pigments, indigo pigments, quinacridone pigments, and the like. The dyes or dyestuffs include cyanine dyes, squarelium dyes, azulenium salts, pyrylium dyes, thiopyrylium dyes, xanthene dyestuffs, quinoneimine dyestuffs, triphenylmethane dyestuffs, styryl dyestuffs, and the like. The inorganic materials include a-Se, a-Si, CdS, Se-Te, and the like. These charge-generating substances may be used singly or in combination of two or more thereof.

The charge-transporting substances include electron-transporting substances, and positive hole-transporting substances. The electron-transporting substances are exemplified by electron-attracting substances such as 2,4,7-trinitrofluorenone, 2,4,5,7-tetranitrofluorenone, chloranil, tetracyanoquinodimethane, etc., and polymerization products of these electron-attracting substances.

The positive hole-transporting substances include polycyclic aromatic compounds such as pyrene, anthracene, etc.; heterocyclic compounds such as carbazoles, indoles, imidazoles, oxazoles, thiazoles, oxadiazoles, pyrazoles, pyrazolines, thiadiazoles, triazoles, etc.; hydrazone compounds such as p-diethylaminobenzaldehydo-N,N-diphenylhydrazone, N,N-diphenylhydrazino-3-methylidene-9-ethylcarbazole, etc.; styryl compounds such as α-phenyl-4'-N,N-diphenylaminostilbene, 5-[4-(di-p-tolylamino)benzylidene]-5H-dibenzo[a,d]cycloheptene, etc.; benzidine compounds, triarylmethane compounds, triphenylamines, and polymers having radicals of one of the above-mentioned compounds in the main chain or the side chain (e.g. poly-N-vinylcarbazole, polyvinylanthracene, etc.).

In addition to these organic charge-transport substances, inorganic materials such as Se, Se-Te, a-Si, CdS, and the like may also be used.

These charge-transporting substances may be used or in combination of two or more thereof.

If the charge-transporting substance does not have a film-forming property, a suitable binder resin may be used. The binder resin therefor includes insulative resins such as acrylic resins, polyarylate resins, polyesters, polycarbonates, polystyrenes, acrylonitrile-styrene copolymers, polyacrylamides, polyamides, chlorinated rubbers, etc.; organic photoconductive polymers such as poly-N-vinylcarbazole, polyvinylanthrathene, etc.; and the like.

Figure 2:
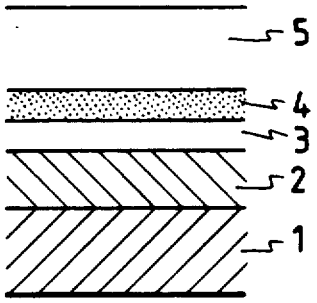
Figure 3:
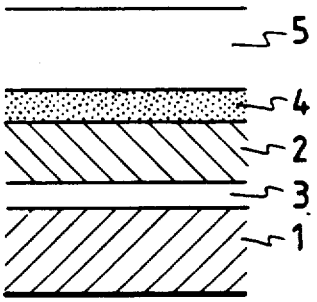

Additionally, an adhesive layer 3 may further be provided for the purpose of improving the adhesiveness of the resin layer containing metal-coated fine resin particles of the present invention to the electroconductive substrate or to the photosensitive layer (see FIGS. 2 and 3).

The resin for the adhesive layer includes casein, gelatin, polyamides such as nylon 6, nylon 66, nylon 610, copolymeric nylon, and alkoxymethylated nylon, etc., polyurethanes, polyvinyl alcohols, nitrocellulose resins, ethylene-acrylate copolymer resins, phenol resins, acrylic resins, polyesters, polyethers, and the like.

Additionally, as a protection layer, a resin layer which may contain electroconductive particles dispersed therein may be provided in the present invention.

The photosensitive layer and the resin layer are applied on the substrate according to a coating method such as dip coating, spray coating, spinner coating, Meyer bar coating, blade coating, roller coating, and curtain coating.

The materials of the electroconductive substrate of the present invention include aluminum, aluminum alloys, copper, zinc, stainless steel, vanadium, molybdenum, chromium, titanium, nickel, indium, gold, platinum, and the like. Other useful materials are plastics such as polyethylene, polypropylene, polyvinyl chloride, polyethylene terephthalate, an acrylic resin, polyfluorinated ethylene, etc., coated with aluminum, aluminum alloy, tin oxide, indium oxide, tin oxide alloy or the like by vacuum vapor deposition; plastics coated with electroconductive particles such as carbon black, particulate silver, together with a suitable binder; plastics or paper impregnated with electroconductive particles; plastics containing an electroconductive polymer; and the like.

The substrate may be in any shape of a cylinder, a sheet, and a belt.

The electrophotographic photosensitive member of the present invention is useful not only for electrophotographic copying machines, but is widely useful in electrophotographic application fields such as for laser beam printers, CRT printers, LED printers, liquid crystal printers, laser engraving, etc.

Figure 4:
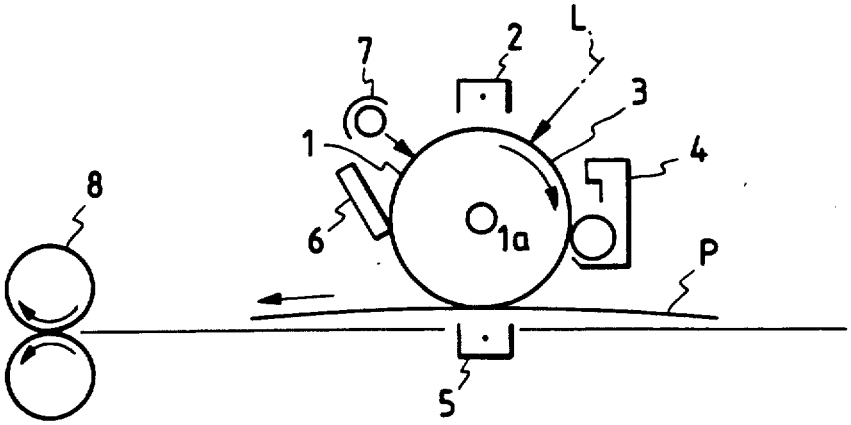
FIG. 4 illustrates roughly an example of constitution of an electrophotographic apparatus employing an electrophotographic photosensitive member of the present invention.

FIG. 4 illustrates an outline of constitution of a usual electrophotographic apparatus employing a photosensitive member of the present invention.

In FIG. 4, a drum type photosensitive member 1 as an image carrier is driven to rotate around the axis 1*a* in a direction indicated with an arrow at a predetermined peripheral velocity. During the rotation, the photosensitive member 1 is electrically charged uniformly to a predetermined positive or negative potential at the peripheral face by the action of an electrifying means 2, and is subsequently subjected to light image exposure L (slit exposure, laser beam scanning exposure, or the like) given by an image exposing means (not shown in the figure) at the exposure section 3. Thereby electrostatic latent images are successively formed on the peripheral surface of the photosensitive member in accordance with the imagewise exposure.

The electrostatic latent image is then developed with a toner by a development means 4, the developed toner image being transferred successively by a transfer means 5 onto a transferred image-receiving material P which is fed synchronously with the rotation of the photosensitive member 1 from a paper feed section (not shown in the figure) to the space between the photosensitive member 1 and a transfer means 5.

The transferred image-receiving material P having received the transferred image is separated from the surface of the photosensitive member, and is introduced into an image fixing means 8 to have the image fixed, and then sent out of the apparatus as a copied material.

After the image transfer, the toner remaining on the surface of the photosensitive member 1 is removed by a cleaning means 6, then treated by a pre-exposure means 7 for decharge, and the cleaned surface is used repeatedly for image formation.

As the electrifying means 2 for uniform charging of the photosensitive member 1, a corona charging apparatus is employed generally. Also as the transfer means 5, a corona charging apparatus is generally employed. In the electrophotographic apparatus, from among the structural elements such as a photosensitive member, a developing means, and a cleaning means, a plurality of the units may be integrated into one apparatus unit so that the apparatus unit may be demountable from the main body of the apparatus. For example, at least one of the electrifying means, the developing means, and the cleaning means is integrated with the photosensitive member into one unit which is mountable and demountable by a guiding means such as a rail in the main body of the apparatus. The aforementioned apparatus unit may comprise an electrifying means and/or a developing means.

In the case where the electrophotographic apparatus is used as a copying machine or a printer, the light image exposure L is given as reflected light or transmitted light from an original copy, or otherwise given by scanning of a laser beam, driving of an LED array, or driving of a liquid crystal shutter array in accordance with the signal made by read-out of an original copy.

Figure 5:
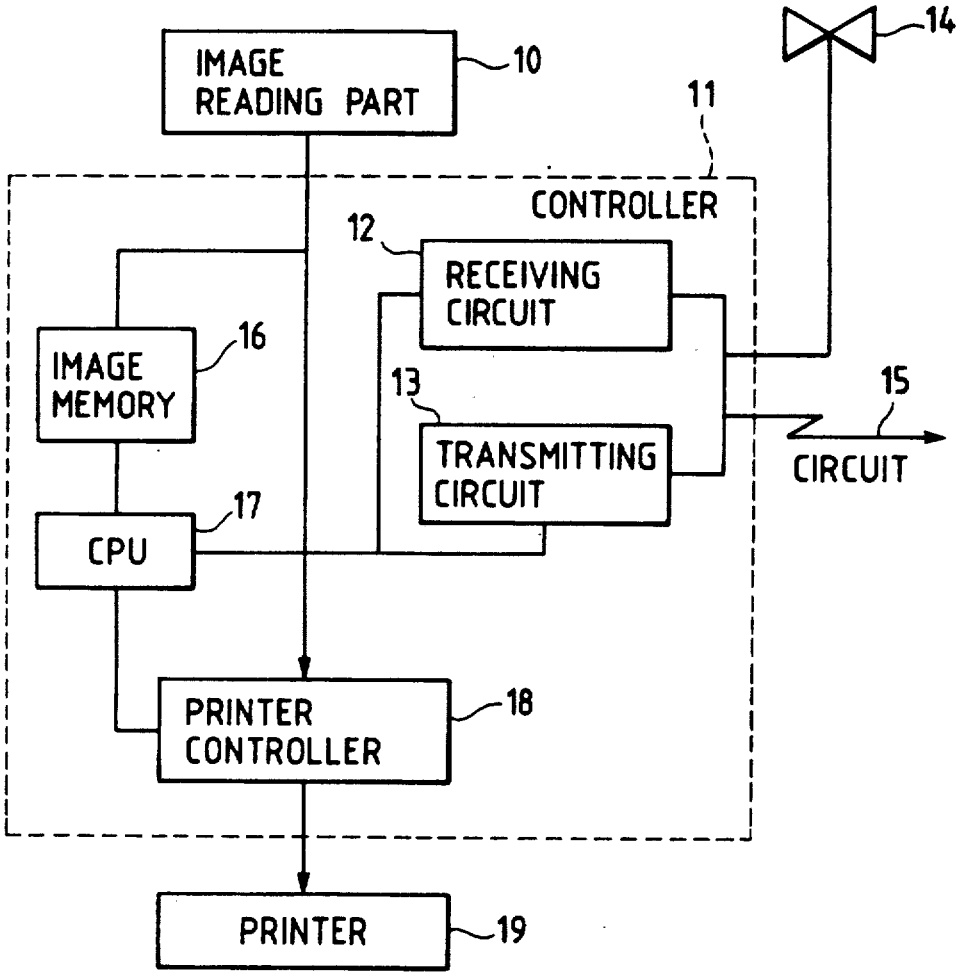
FIG. 5 shows a block diagram of a facsimile machine employing as a printer an electrophotographic apparatus having an electrophotographic photosensitive member of the present invention.

In the case where the electrophotographic apparatus is used as a printer of a facsimile apparatus, the light image exposure L is conducted for printing out the received data. FIG. 5 shows a block diagram of an example for such a case.

A controller 11 controls an image reading section 10 and a printer 19. The whole of the controller 11 is controlled by CPU 17. The read-out data from the image reading section is transmitted to the other communication party through a transmitting circuit. Data received from the other communication party is sent to a printer 19 through a receiving circuit 12. The image data is stored in an image memory 16. A printer controller 18 controls a printer 19. The numeral 14 denotes a telephone.

An image received through a circuit 15 (image information from a remote terminal connected through the circuit), after demodulated with the receiving circuit 12, decoded by CPU 17 and successively stored in the image memory 16. When at least one page of image have been stored in the image memory 16, recording of the image of the page is conducted. The CPU 17 reads out one page of image information from the image memory 16, and sends out the decoded one page of image information to the printer controller 18 which controls a printer 19 so as to record the one page of image information on receiving the one page of image information from CPU 17.

The CPU 17 receives the following page during the recording by the printer 19.

Images are received and recorded in a manner as described above.

The present invention is described more specifically by referring to examples. In the examples, "parts" is based on weight unless otherwise mentioned.

EXAMPLE 1

On the surface of fine spherical particles of a silicone resin (polymethylsilsesquioxane having a specific gravity of 1.3 and a volume-average particle diameter of 1.2 μm), a vapor-deposited film of aluminum (work function: 4.28) was formed in a thickness of $5.0\times10^{-2}$ μm by vacuum vapor deposition. Subsequently, 50 parts by weight of the aluminum-deposited spherical silicone resin, 50 parts by weight of a phenol resin (trade name: PLi-o-phen, made by Dainippon Ink & Chemicals, Inc.), and 0.02 parts by weight of a silicone type surfactant (trade name: Toray Silicone, made by Toray Industries, Inc.) were mixed with 20 parts by weight of methanol and 20 parts by weight of methylcellosolve, and then the mixture was treated for dispersion by means of a sand mill for one hour. The liquid disperesion was applied onto an aluminum cylinder by dip coating, and air-dried at 150° C. for 30 minutes to form a resin layer of 20 μm thick. The resin layer was measured to have a volume resistivity of $2.1\times10^{6}$ Ωcm.

Subsequently, 10 parts of a disazo pigment of the structural formula below,

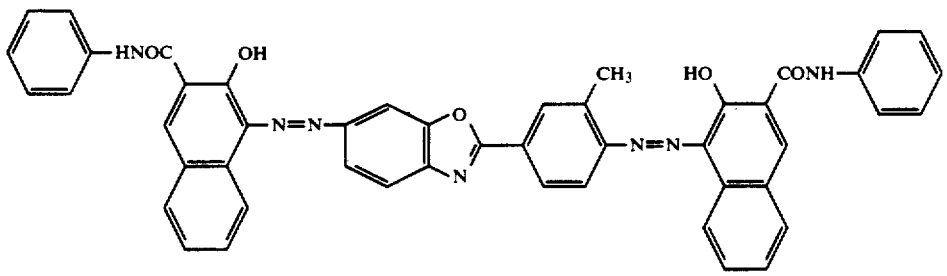

6 parts of cellulose acetate butyrate resin (trade name: CAB-381, made by Eastman Chemical Co.), and 60 parts of cyclohexanone were dispersed for 20 hours by means of a sand mill employing glass beads of 1 mm diameter. The liquid dispersion was mixed with 100 parts of methyl ethyl ketone. The mixture was applied on the aforementioned resin layer by dip coating, and dried at 100° C. for 10 minutes to give a charge-generating layer in a coating amount of 0.1 g/m².

Then, 10 parts of the hydrazone compound of the structural formula below:

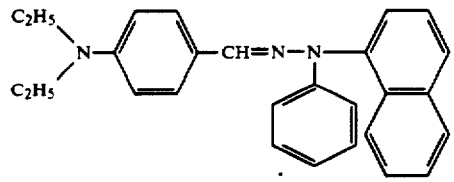

15 parts of a polycarbonate resin (trade name: Panlite L-1250, made by Teijin Kasei K. K.) were dissolved in 80 parts of dichloromethane. The solution was applied on the aforementioned charge-generating layer, and air-dried at 100° C. for one hour to form a charge-transporting layer of 20 μm thick.

The resulting photosensitive member was mounted on a copying machine (trade name: NP-3525, made by Canon K. K.), and image copying was conducted. The image qualities at the initial stage and after 50,000 sheets of image formation are shown in Table 1.

The dark portion potentials and the exposure potentials were measured at the initial stage and after 50,000 sheets of image formation. The stability of the potential is shown in Table 1. The quantity of the exposure was 2 lux.sec.

EXAMPLE 2

A resin layer was provided on an aluminum cylinder in the same manner as in Example 1 except that fine spherical silicone resin particles having a volume-average diameter of 2.0 μm were used in place of the ones having the volume-average diameter of 1.2 μm employed in Example 1. This resin layer had a volume resistivity of $3.7\times10^6$ Ωcm. Further on this resin layer, a charge-generating layer and a charge-transporting layer were provided and the resulting photosensitive member was evaluated in the same manner as in Example 1. The results of the evaluation are shown in Table 1.

COMPARATIVE EXAMPLE 1

A resin layer was provided on an aluminum cylinder in the same manner as in Example 1 except that tin oxide particles (work function: 5.7) were used in place of the aluminum-deposited fine spherical silicone resin particles of Example 1 and the dispersion was conducted for 6 hours. This resin layer had a volume resistivity of $7.6\times10^7$ Ωcm. Further on this resin layer, a charge-generating layer and a charge-transporting layer were provided, and the resulting photosensitive member was evaluated in the same manner as in Example 1.

The evaluation results are shown in Table 1. As shown in Table 1, the photosensitive member of Example 1 and Example 2 were greatly superior in the potential retention and the potential contrast, and gave higher quality of the image in comparison with the Comparative example 1.

TABLE 1

| | Example 1 | Example 2 | Comparative Example 1 |
|---|---|---|---|
| Electroconductive particles | Aluminum-coated silicone resin | Aluminum-coated silicone resin | Tin oxide particles |
| Work function of metal for electroconductive particles | 4.28 | 4.28 | 5.7 |
| Image quality at initial stage | Resolution: high<br>No black dot formed<br>No white dot formed<br>No fogging caused | Resolution: high<br>No black dot formed<br>No white dot formed<br>No fogging caused | Resolution: low<br>Many white dots formed |
| Image quality after 50,000 sheets of image formation | Excellent | Excellent | Occurrence of image defects |
| At initial stage | | | |
| Dark portion potential | −700 V | −710 V | −400 V |
| Exposure potential | −180 V | −170 V | −190 V |
| After 50,000 sheets of image formation | | | |
| Dark portion potential | −690 V | −700 V | −310 V |
| Exposure potential | −200 V | −190 V | −250 V |

EXAMPLE 3

On the surface of fine particles of melamine resin (a melamine-formaldehyde copolymer, specific gravity: 1.40, volume-average particle diameter: 3.0 μm), a vapor-deposited film of silver (work function: 4.26) was formed in a thickness of $4.0\times10^{-2}$ μm by vacuum vapor deposition.

A resin layer was provided in the same manner as in Example 1 except that the above-mentioned fine particles of melamine having vapor deposited silver in place of the aluminum-deposited fine spherical silicone resin particles of Example 1. This resin layer had a volume resistivity of $1.6\times10^7$ Ωcm.

Subsequently, 10 parts of a copolymeric nylon resin (trade name: AMILAN CM8000, made by Toray Industries, Inc.) was dissolved in a mixed solvent of 60 parts of methanol and 40 parts of butanol. The solution was applied on the resin layer by dip coating to provide an adhesive layer of 0.5 μm thick.

Further on the adhesive layer, a charge-generating layer and a charge-transporting layer were provided in the same manner as in Example 1 to prepare a photosensitive member. The photosensitive member was evaluated in the same manner as in Example 1. The results are shown in Table 2.

EXAMPLE 4

A resin layer was provided in the same manner as in Example 3 except that fine melamine resin particles having a volume-average diameter of 4.8 μm was used in place of the one of 3.0 μm diameter employed in Example 3. The resin layer had a volume resistivity of $3.3\times10^7$ Ωcm.

Then an adhesive layer was provided in the same manner as in Example 3.

Further on the adhesive layer, a charge-generating layer and a charge-transporting layer were provided in the same manner as in Example 1 to produce a photosensitive member. The photosensitive member was evaluated in the same manner as in Example 1. The results are shown in Table 2.

COMPARATIVE EXAMPLE 2

A resin layer was provided in the same manner as in Comparative example 1 except that silver particles were employed in place of tin oxide particles of Comparative example 1. The resin layer was found to have a volume resistivity of $7.1\times10^6$ Ωcm.

Then an adhesive layer was provided in the same manner as in Example 3.

Further on the adhesive layer, a charge-generating layer and a charge-transporting layer were provided in the same manner as in Example 1 to produce a photosensitive member. The photosensitive member was evaluated in the same manner as in Example 1. The results are shown in Table 2.

TABLE 2

| | Example 3 | Example 4 | Comparative Example 2 |
|---|---|---|---|
| Electroconductive particles | Silver-coated melamine resin | Silver-coated melamine resin | Silver particles |
| Work function of metal for electroconductive particles | 4.26 | 4.26 | 4.26 |
| Image quality at initial stage | Resolution: high<br>No black dot formed<br>No white dot formed<br>No fogging caused | Resolution: high<br>No black dot formed<br>No white dot formed<br>No fogging caused | Resolution: low<br>Many white dots formed |
| Image quality after 50,000 sheets of image formation | Excellent | Excellent | Occurrence of image defects |
| At initial stage | | | |
| Dark portion potential | −680 V | −690 V | −600 V |
| Exposure potential | −180 V | −170 V | −190 V |
| After 50,000 sheets of image formation | | | |
| Dark portion potential | −690 V | −700 V | −580 V |
| Exposure potential | −210 V | −195 V | −250 V |

EXAMPLE 5

Fine spherical phenol resin particles (specific gravity: 1.26, volume average particle diameter: 1.5 μm) and zinc particles (work function: 4.33) were put into a ball mill, and were treated by rotation under a dry condition for 6 hours with porcelain balls of 1.0 mm diameter to prepare fine spherical phenol resin particles coated with zinc.

A liquid dispersion for a resin layer was prepared in the same manner as in Example 1 except that the above-mentioned fine spherical phenol resin particles coated with zinc were used in place of the aluminum-coated fine spherical silicone resin particles.

Firstly, 10 parts of a copolymeric nylon resin (trade name: AMILAN CM8000, made by Toray Industries, Inc.) was dissolved in a mixed solvent of 60 parts of methanol and 40 parts of butanol. The solution was applied on an aluminum cylinder by dip coating to provide an adhesive layer of 0.3 μm thick. Then on this adhesive layer, a resin layer was provided by use of the above-mentioned liquid dispersion. The resin layer had a volume resistivity of $3.6\times10^7$ Ωcm. Further on the adhesive layer, a charge-generating layer and a charge transporting layer were provided in the same manner as in Example 1 to prepare a photosensitive member. The photosensitive member was evaluated in the same manner as in Example 1. The results are shown in Table 3.

EXAMPLE 6

A liquid dispersion for a resin layer was prepared in the same manner as in Example 5 except that fine phenol resin particles having a volume-average particle diameter of 3.8 μm were employed in place of the one of 1.5 μm diameter employed in Example 5.

Firstly, an adhesive layer was provided on an aluminum cylinder in the same manner as in Example 5.

Subsequently, a resin layer was provided on the adhesive layer by use of the above-mentioned liquid dispersion. The resin layer had a volume resistivity of $2.5\times10^7$ Ωcm. Further on this resin layer, a charge-generating layer and a charge-transporting layer were provided in the same manner as in Example 1 to produce a photosensitive member. This photosensitive member was evaluated in the same manner as in Example 1. The results are shown in Table 3.

COMPARATIVE EXAMPLE 3

A liquid dispersion for a resin layer was prepared in the same manner as in Comparative example 1 except that zinc particles were used in place of the tin oxide particles of Comparative example 1.

Firstly, an adhesive layer was provided on an aluminum cylinder in the same manner as in Example 5.

Subsequently, a resin layer was provided on the adhesive layer by use of the above-mentioned liquid dispersion. The resin layer had a volume resistivity of $9.4\times10^6$ Ωcm. Further on this resin layer, a charge-generating layer and a charge-transporting layer were provided in the same manner as in Example 1 to produce a photosensitive member. This photosensitive member was evaluated in the same manner as in Example 1. The results are shown in Table 3.

In the examples of the present invention, the metal deposition was conducted as follows. A metal vapor source, and a fine resin particles on the sample holder were placed in a vapor deposition chamber. The chamber is evacuated and kept at approximately 0.2 Torr. A voltage of 1200 V is applied to the sample holder, and vapor-deposition is conducted for 15 minutes at the vacuum degree in the chamber being adjusted to maintain the current at 2.5 mA.

TABLE 3

| | Example 5 | Example 6 | Comparative Example 3 |
|---|---|---|---|
| Electroconductive particles | Zinc-coated phenol resin | Zinc-coated phenol resin | Zinc particles |
| Work function of metal for electroconductive particles | 4.33 | 4.33 | 4.33 |
| Image quality at initial stage | Resolution: high<br>No black dot formed<br>No white dot formed<br>No fogging caused | Resolution: high<br>No black dot formed<br>No white dot formed<br>No fogging caused | Resolution: low<br>Many white dots formed |
| Image quality | Excellent | Excellent | Occurrence of |

TABLE 3-continued

| | Example 5 | Example 6 | Comparative Example 3 |
|---|---|---|---|
| after 50,000 sheets of image formation | | | image defects |
| At initial stage | | | |
| Dark portion potential | −670 V | −670 V | −620 V |
| Exposure potential | −175 V | −165 V | −190 V |
| After 50,000 sheets of image formation | | | |
| Dark portion potential | −690 V | −690 V | −590 V |
| Exposure potential | −200 V | −195 V | −250 V |

EXAMPLE 7

Fine spherical silicone resin particles (polymethylsilsesquioxane, specific gravity: 1.3, volume-average particle diameter: 1.2 μm) and particles of chromium (work function: 4.50) were put into a ball mill, and were treated by rotation under a dry condition for 6 hours with porcelain balls of 1.0 mm diameter to prepare fine spherical silicone resin particles coated with chromium.

A resin layer was provided in the same manner as in Example 1 except that the above-mentioned fine spherical silicone resin particles coated with chromium was employed in place of the aluminum-coated fine spherical silicone resin particles of Example 1. This resin layer had a volume resistivity of $2.6\times10^7$ Ωcm.

Subsequently, 10 parts of a copolymeric nylon resin (trade name: AMILAN CM8000, made by Toray Industries, Inc.) was dissolved in a mixed solvent of 60 parts of methanol and 40 parts of butanol. The solution was applied on the resin layer by dip coating to provide an adhesive layer of 0.5 μm thick.

Further on the adhesive layer, a charge-generating layer and a charge-transporting layer were provided in the same manner as in Example 1 to produce a photosensitive member. The photosensitive member was evaluated in the same manner as in Example 1. The results are shown in Table 4.

EXAMPLE 8

Fine spherical silicone resin particles (polymethylsilsesquioxane, specific gravity: 1.3, volume-average particle diameter: 1.2 μm) and particles of nickel (work function: 5.15) were put into a ball mill, and were treated by rotation under a dry condition for 6 hours with porcelain balls of 1.0 mm diameter to prepare fine spherical silicone resin particles coated with nickel.

A resin layer was provided in the same manner as in Example 1 except that the above-mentioned fine spherical silicone resin particles coated with nickel was employed in place of the fine spherical aluminum-coated silicone resin particles of Example 1. This resin layer had a volume resistivity of $2.1\times10^7$ Ωcm.

Subsequently, an adhesive layer was provided in the same manner as in Example 7. Further on the adhesive layer, a charge-generating layer and a charge-transporting layer were provided in the same manner as in Example 1 to produce a photosensitive member. The photosensitive member was evaluated in the same manner as in Example 1. The results are shown in Table 4.

COMPARATIVE EXAMPLE 4

A resin layer was provided in the same manner as in Comparative example 1 except that particles of nickel (work function: 5.15) were employed in place of tin oxide particles of Comparative example 1. The resin layer was found to have a volume resistivity of $2.8\times10^6$ Ωcm.

Then an adhesive layer was provided in the same manner as in Example 7.

Further on the adhesive layer, a charge-generation layer and a charge-transporting layer were provided in the same manner as in Example 1 to produce a photosensitive member. The photosensitive member was evaluated in the same manner as in Example 1. The results are shown in Table 4.

TABLE 4

| | Example 7 | Example 8 | Comparative Example 4 |
|---|---|---|---|
| Electroconductive particles | Chromium-coated silicone resin | Nickel-coated silicone resin | Nickel particles |
| Work function of metal for electroconductive particles | 4.50 | 5.15 | 5.15 |
| Image quality at initial stage | Resolution: high<br>No black dot formed<br>No white dot formed<br>No fogging caused | Resolution: high<br>No black dot formed<br>No white dot formed<br>No fogging caused | Resolution: low<br>Many white dots formed |
| Image quality after 50,000 sheets of image formation | Excellent | Fogging caused | Occurrence of image defects |
| At initial stage | | | |
| Dark portion potential | −700 V | −600 V | −400 V |
| Exposure potential | −185 V | −170 V | −195 V |
| After 50,000 sheets of image formation | | | |
| Dark portion potential | −690 V | −540 V | −310 V |
| Exposure potential | −210 V | −195 V | −230 V |

EXAMPLE 9

A resin layer was formed on an aluminum cylinder by coating in the same manner as in Example 7 except that metal silicon particles (work function 485) were employed in place of the chromium particles of Example 7.

This resin layer had a volume resistivity of $2.8\times10^7$ Ωcm.

Further in the same manner as in Example 7, an adhesive layer, a charge-generating layer, and a charge-transporting layer were provided to produce a photosensitive member, and the resulting photosensitive member was evaluated. The results are shown in Table 5.

EXAMPLE 10

A resin layer was applied on an aluminum cylinder by coating in the same manner as in Example 7 except that particles of rhodium (work function: 4.98) were employed in place of the chromium particles of Example 7.

This resin layer had a volume resistivity of $2.1\times10^7$ Ωcm.

Further in the same manner as in Example 7, an adhesive layer, a charge-generating layer, and a charge-transporting layer were provided to produce a photosensitive member, and the resulting photosensitive member was evaluated. The results are shown in Table 5.

COMPARATIVE EXAMPLE 5

A resin layer was provided in the same manner as in Comparative example 1 except that particles of metal silicon were employed in place of the tin oxide particles of Comparative example 1. The resin layer was found to have a volume resistivity of $2.8\times10^6$ Ωcm.

Further in the same manner as in Example 7, an adhesive layer, a charge-generating layer, and a charge-transporting layer were provided to produce a photosensitive member, and the resulting photosensitive member was evaluated. The results are shown in Table 5.

TABLE 5

| | Example 9 | Example 10 | Comparative Example 5 |
|---|---|---|---|
| Electroconductive particles | Silicon-coated silicone resin | Rhodium-coated silicone resin | Silicon particles |
| Work function of metal for electroconductive particles | 4.85 | 4.98 | 4.85 |
| Image quality at initial stage | Resolution: high<br>No black dot formed<br>No white dot formed<br>No fogging caused | Resolution: high<br>No black dot formed<br>No white dot formed<br>No fogging caused | Resolution: low<br>Many white dots formed<br>Fogging caused |
| Image quality after 50,000 sheets of image formation | Fogging caused | Fogging caused | Occurrence of image defects |
| At initial stage | | | |
| Dark portion potential | −640 V | −615 V | −510 V |
| Exposure potential | −175 V | −165 V | −190 V |
| After 50,000 sheets of image formation | | | |
| Dark portion potential | −620 V | −605 V | −420 V |
| Exposure potential | −200 V | −190 V | −225 V |

EXAMPLE 11

On the surface of fine spherical particles of a silicone resin (polymethylsilsesquioxane having a specific gravity of 1.3 and a volume-average particle diameter of 1.2 μm), a vapor-deposited film of aluminum (work function: 4.28) was formed in a thickness of $5.0\times10^{-2}$ μm by vacuum vapor deposition. Subsequently, 50 parts by weight of the aluminum-deposited fine spherical silicone resin particles, 50 parts by weight of a melamine resin (trade name: Super Bekkamine, made by Dainippon Ink & Chemicals, Inc.), and 0.02 parts by weight of a solicone type surfactant (trade name: Toray Silicone made by Toray Industries, Inc.) were mixed with a solvent of 20 parts by weight of toluene and 20 parts by weight of cyclohexanone, and then the mixture was treated by means of a sand mill for dispersion for one hour. The dispersed liquid was applied onto an aluminum cylinder by dip coating, and air-dried at 150° C. for 30 minutes to form a resin layer of 20 μm thick. The resin layer was measured to have a volume resistivity of $3.5\times10^6$ Ωcm.

Subsequently, 10 parts of a disazo pigment of the structural formula below,

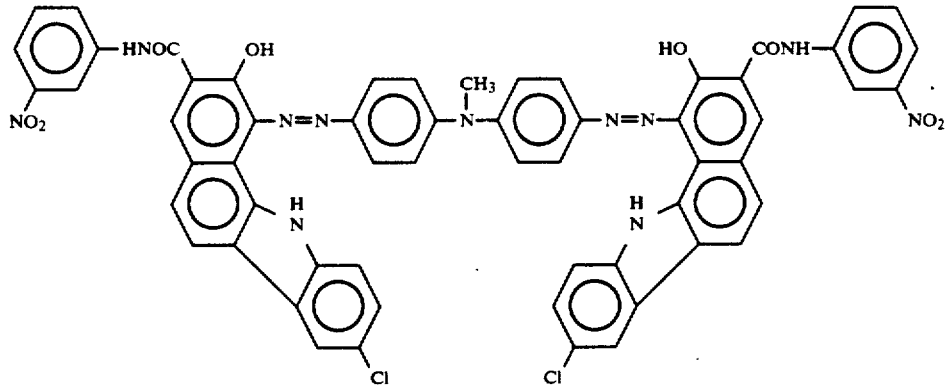

5 parts of an acrylic resin (trade name: DIANAL BR-80, made by Mitsubishi Rayon Co., Ltd.), and 60 parts of cyclohexanone were dispersed for 20 hours by means of a sand mill employing glass beads of 1 mm diameter.

The liquid dispersion was mixed with 2700 parts by weight of methyl ethyl ketone. The mixture was applied on the aforementioned resin layer by dip coating, and dried at 50° C. for 10 minutes to give a charge-generating layer in a coating amount of 0.15 g/m$^2$.

Then, 10 parts of the hydrazone compound of the structural formula below:

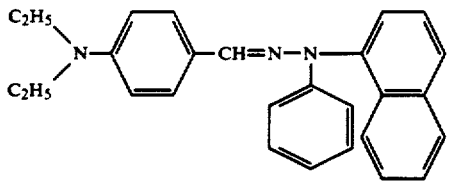

15 parts of a polycarbonate resin (trade name: Panlite L-1250, made by Teijin Kasei K. K.) were dissolved in 80 parts of dichloromethane. The solution was applied on the aforementioned charge-generating layer, and hot-air-dried at 100° C. for one hour to form a charge-transporting layer of 20 μm thick.

The resulting photosensitive member was mounted on a laser printer (trade name: LBP-8, made by Canon K. K.), and image formation was conducted. The image qualities at the initial stage and after 10,000 sheets of image formation are shown in Table 6.

The dark portion potentials and the exposure potentials were measured at the initial stage and after 10,000 sheets of image formation. The stability of the potential is shown in Table 6. The quantity of the exposure was 2 μJ/cm$^2$.

EXAMPLE 12

A resin layer was provided on an aluminum cylinder in the same manner as in Example 11 except that fine spherical silicone resin particles having a volume-average diameter of 2.0 μm were used in place of the ones having the volume-average diameter of 1.2 μm employed in Example 11. This resin layer had a volume resistivity of $3.7\times10^6$ Ωcm. Further on this resin layer, a charge-generating layer and a charge-transporting layer were provided in the same manner as in Example 11. The results of the evaluation of the photosensitive member are shown in Table 6.

COMPARATIVE EXAMPLE 6

A resin layer was provided on an aluminum cylinder in the same manner as in Example 11 except that aluminum particles were used in place of the aluminum-coated fine silicone resin particles of Example 11 and the dispersion was conducted for 6 hours. This resin layer had a volume resistivity of $6.7\times10^7$ Ωcm.

Further on this resin layer, a charge-generating layer and a charge-transporting layer were provided, and the resulting photosensitive member was evaluated in the same manner as in Example 11.

The evaluation results are shown in Table 6.

In the examples of the present invention, the work function was measured with a surface analyzer AC-1 made by Riken Keiki Fine Instrument Co., Ltd., and the volume resistivity was measured with Hiresta IP made by Mitsubishi Petrochemical Co., Ltd.

TABLE 6

| | Example 11 | Example 12 | Comparative Example 6 |
|---|---|---|---|
| Electroconductive particles | Aluminum-coated silicone resin | Aluminum-coated silicone resin | Aluminum particles |
| Work function of metal for electroconductive particles | 4.28 | 4.28 | 4.28 |
| Image quality at initial stage | Resolution: high<br>No black dot formed<br>No white dot formed<br>No fogging caused<br>No interference fringe formed | Resolution: high<br>No black dot formed<br>No white dot formed<br>No fogging caused<br>No interference fringe formed | Resolution: low<br>Many black dots formed |
| Image quality after 10,000 sheets of image formation | Excellent | Excellent | Occurrence of image defects |
| At initial stage | | | |
| Dark portion potential | −700 V | −710 V | −600 V |
| Exposure potential | −100 V | −105 V | −120 V |
| After 10,000 sheets of image formation | | | |
| Dark portion potential | −690 V | −700 V | −480 V |
| Exposure potential | −105 V | −110 V | −90 V |

What is claimed is:

1. An image holding member which carries an electrostatic image or a toner image comprising an electroconductive substrate, a resin layer, and an image holding layer, said resin layer being placed between the electroconductive substrate and the image holding layer, and said resin layer comprising metal-coated fine resin particles and a binder resin.

2. An image holding member according to claim 1, wherein the metal is selected from the group consisting of Al, Ag, Zn, Cr, Si, Rh, Au, and Ni.

3. An image holding member according to claim 1, wherein the metal has a work function of not more than 4.6.

4. An image holding member according to claim 2, wherein the metal is selected from Al, Ag, Zn, and Cr.

5. An image holding member according to claim 1, wherein the fine resin particles have a volume-average particle diameter within the range of from 0.1 μm to 4 μm.

6. An image holding member according to claim 5, wherein the volume-average particle diameter is not less than 0.5 μm and not more than 3 μm.

7. An image holding member according to claim 1, wherein the image holding layer is a photosensitive layer.

8. An image holding member according to claim 7, wherein the photosensitive layer is of a monolayer type.

9. An image holding member according to claim 7, wherein the photosensitive layer comprises a charge-generating layer and a charge-transporting layer.

10. An image holding member according to claim 9, wherein the charge-transporting layer is laminated on the charge-generating layer.

11. An image holding member according to claim 9, wherein the charge-generating layer is laminated on the charge-transporting layer.

12. An image holding member according to claim 9, wherein the charge-generating layer contains an organic photoconductive substance.

13. An image holding member according to claim 7, wherein the image holding member comprises an adhesive layer between the electroconductive substrate and the resin layer.

14. An image holding member according to claim 7, wherein the image holding member comprises an adhesive layer between the resin layer and the photosensitive layer.

15. An image holding member according to claim 7, wherein the image holding member comprises a protection layer on the photosensitive layer.

* * * * *

UNITED STATES PATENT AND TRADEMARK OFFICE

CERTIFICATE OF CORRECTION

PATENT NO. : 5,190,837

DATED : March 2, 1993

INVENTOR(S) : Kiyoshi Sakai, et al.

It is certified that error appears in the above-indentified patent and that said Letters Patent is hereby corrected as shown below:

COLUMN 1

Line 11, "characteristics." should read --characteristics. ¶ Related Background Art--.

COLUMN 3

Line 36, "includes" should read --include--.
Line 39, "includes" should read --include--.
Line 47, "includes" should read --include--.
Line 54, "includes" should read --include--.
Line 57, "includes" should read --include--.

COLUMN 5

Line 34, "used" should read --used singly--.
Line 43, "polyvinylanthrathene," should read --polyvinylanthracene,--.

COLUMN 7

Line 42, "demodulated" should read --being demodulated--.
Line 43, "decoded" should read --is decoded--.

COLUMN 8

Line 8, "disperesion" should read --dispersion--.

UNITED STATES PATENT AND TRADEMARK OFFICE

CERTIFICATE OF CORRECTION

PATENT NO. : 5,190,837

DATED : March 2, 1993

INVENTOR(S) : Kiyoshi Sakai, et al.

It is certified that error appears in the above-indentified patent and that said Letters Patent is hereby corrected as shown below:

COLUMN 9

Line 28, "member" should read --members--.

COLUMN 11

Line 54, "one" should read --ones--.

COLUMN 12

Line 51, "a" should be deleted.

UNITED STATES PATENT AND TRADEMARK OFFICE

CERTIFICATE OF CORRECTION

PATENT NO. : 5,190,837

DATED : March 2, 1993

INVENTOR(S) : Kiyoshi Sakai, et al.

It is certified that error appears in the above-indentified patent and that said Letters Patent is hereby corrected as shown below:

COLUMN 15

Line 1, "(work function 485)" should read --(work function 4.85)--.

COLUMN 16

Line 35, "solicone" should read --silicone--.

Signed and Sealed this

Fourteenth Day of March, 1995

*Attest:*

*Attesting Officer*

BRUCE LEHMAN

*Commissioner of Patents and Trademarks*